US006076531A

United States Patent [19]

Gueret

[11] Patent Number: 6,076,531

[45] Date of Patent: Jun. 20, 2000

[54] DEVICE INCLUDING A BRUSH FOR APPLYING MAKEUP, A METHOD OF MANUFACTURE, AND AN APPLICATOR

[75] Inventor: Jean-Louis Gueret, Paris, France

[73] Assignee: L'Oreal, Paris, France

[21] Appl. No.: 09/366,329

[22] Filed: Aug. 2, 1999

[30] Foreign Application Priority Data

Aug. 3, 1998 [FR] France ..... 98 09928

[51] Int. Cl.[7] ..... A45D 40/26

[52] U.S. Cl. ..... 132/218; 132/320; 401/122

[58] Field of Search ..... 132/216, 218, 132/317, 313, 320; 401/122, 126, 129, 128; 15/207.2, DIG. 5, 160, 172; 206/581, 823

[56] References Cited

U.S. PATENT DOCUMENTS

| | | | |
|---|---|---|---|
| 4,662,385 | 5/1987 | Schefer | 132/218 |
| 5,022,559 | 6/1991 | Condon | 15/104.94 |
| 5,309,929 | 5/1994 | Toll | 132/218 |
| 5,556,214 | 9/1996 | Ascolese | 132/218 |
| 5,743,279 | 4/1998 | Gueret | 132/218 |
| 5,810,497 | 9/1998 | Bachmann et al. | 401/129 |
| 5,865,556 | 2/1999 | Lhuisset | 401/129 |

*Primary Examiner*—Gene Mancene
*Assistant Examiner*—Pedro Philogene
*Attorney, Agent, or Firm*—Oliff & Berridge, PLC

[57] ABSTRACT

A device for applying a substance, in particular a cosmetic such as mascara, includes a receptacle containing a supply of the substance, and an applicator having an axis, the applicator being provided on the axis at one end with a handle element and at the other end with an applicator element, the handle element and the applicator element being interconnected by a link element. The applicator element includes a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about the core.

40 Claims, 6 Drawing Sheets

DEVICE INCLUDING A BRUSH FOR APPLYING MAKEUP, A METHOD OF MANUFACTURE, AND AN APPLICATOR

The present invention relates to the field of devices for applying makeup, e.g. mascara.

BACKGROUND OF THE INVENTION

Devices for applying mascara are known which comprise a receptacle containing a supply of the makeup and fitted with a wiper member, and an applicator provided at one end with a handle element and at its other end with an applicator element, the handle element and the applicator element being united by a link element, the applicator element being withdrawn from the receptacle through the wiper member.

In particular, devices are known in which the applicator element is constituted by a twisted wire brush type of brush, i.e. a brush whose bristles are held between the turns of a core that is made up of at least two wires twisted together.

The brush is fixed to the end of a rod secured to a handle element that also constitutes a cap for closing the receptacle.

Such devices make it possible to apply makeup properly, however the orientation of the bristles relative to the axis of the applicator does not enable the eyelashes to be coated in makeup, to be smoothed, to be separated, or to be curved in a manner that is entirely satisfactory.

Thus, French patent application FR-A-2 738 127 proposes an applicator whose applicator element is constituted by a flat brush.

That brush comprises a series of bristles implanted in the end of the handle of the applicator and lying substantially on the axis thereof.

Compared with the above-mentioned applicators that include a twisted wire brush type of brush, that type of applicator presents the advantage of using bristles that are longer so that making-up can be performed more quickly and also providing satisfactory results concerning separation and curving of the eyelashes.

In particular, the applicator makes it possible to smooth the eyelashes over their entire length, from the base to the tip, by using a simple movement with the bristles of the applicator extending tangentially relative to the eyelashes.

Nevertheless, it is more difficult to install the bristles on the handle of that type of applicator than it is when making a twisted wire brush type of brush.

In particular, when the bristles are implanted in tufts on the handle and are clamped thereto, they tend to splay apart from the axis of the handle, so that method of fixing the bristles does not enable them to be oriented accurately or with a distribution that is as uniform as desired.

OBJECTS AND SUMMARY OF THE INVENTION

A particular object of the invention is to provide a novel device for applying a substance, in particular a cosmetic, that has the above-mentioned advantages of a flat brush while still making it easier to install the bristles.

The device of the invention comprises a receptacle containing a supply of substance, and an applicator having an axis, the applicator being provided on said axis at one end with a handle element and at the other end with an applicator element, the handle element and the applicator element being interconnected by a link element, wherein the applicator element comprises a twisted wire brush type brush whose core extends in a direction that is not parallel to the axis of the applicator, and wherein the link element and the brush are shaped in such a manner that the bristles extending from the link element for use in applying the substance are contained in a sector of angular extent that is not greater than 180° about said core.

By means of the invention, an applicator is made available in which the bristles of the applicator element are easy to fix to the applicator while using the techniques that are conventional in the manufacture of twisted wire brush type brushes.

The invention also makes it easy to orient the bristles in a desired direction, possibly by using the link element to constrain them to take up a determined orientation, and the invention also makes it easy to obtain a relatively uniform distribution of the bristles.

Preferably, the brush is secured at at least two points along its length to the link element.

In a particular embodiment, the link element is substantially flat.

Still in a particular embodiment, the bristles for applying the substance extend over a sector of angular extent about the core that is less than 120°, preferably less than 900, and more preferably less than 60°.

When the device has a wiper member housed in the receptacle with the applicator element being extracted from the receptacle through the wiper member, the link element is advantageously of a width not less than the width of the brush, so that the core of the brush is completely sheltered by the link element when the brush goes through the wiper member.

In other words, in spite of the fact that the core is not parallel to the direction in which the applicator is extracted from the receptacle, the brush is protected by the link element against any damage from the wiper member while the applicator is being inserted or withdrawn, and the wiper member can be relatively simple in structure.

The link element is advantageously shaped in such a manner as to prevent the bristles that are used for applying the substance from bending back when the applicator is returned into the receptacle.

In addition, the link element can advantageously contribute to stiffening the bristles of the brush that are used for applying the substance by holding them in a determined direction, whereas without the link element, the bristles would be held only by the core and would bend too easily, thus impeding combing and smoothing of the eyelashes, for example.

In addition, by means of the invention, it is possible without any particular constraint to implant any type of bristle suitable for use when making twisted wire brush type brushes, and in particular it is possible to use bristles of cross-section that is not circular and/or not constant from one end of the bristle to the other, thereby obtaining a specific makeup effect.

In particular, it is possible to use all of the types of bristle described in above-mentioned French patent application FR-A-2 738 127, and in particular bristles that are soft, elastic, slippery, antibacterial, flat, of fluted section, hollow, folding, twisted, or corkscrew-shaped, with a mixture of various diameters, with different diameters in alternation, with different sections either mixed together or in alternation, the bristles being more or less numerous, with treatments being applied to their ends and/or along their length, of various lengths, and/or flocked.

In a particular embodiment, the bristles for applying the substance constitute a bundle centered on a plane containing the axis of the applicator.

In another particular embodiment, the bristles for applying the substance constitute a bundle centered on a plane extending obliquely relative to the axis of the applicator.

Still in a particular embodiment, the bristles for applying the substance constitute a bundle that diverges going away from the link element when the applicator is observed in section in a plane perpendicular to the core.

In another particular embodiment, the bristles for applying the substance constitute a bundle that converges going away from the link element when the applicator is observed in a section plane perpendicular to the core.

In another particular embodiment, the bristles for applying the substance are substantially parallel in their free portions extending beyond the link element.

Still in a particular embodiment, the bristles for applying the substance constitute a bundle in which the bristles are of length that decreases from the inside of the bundle towards the outside of the bundle when the applicator is observed in section in a plane perpendicular to the core.

In another particular embodiment, the link element has a groove and the core of the brush is inserted in the groove, the length of the groove is preferably not less than the length of the core so that the brush is held to the link element over its entire length.

Relatively short bristles are advantageously left around the core of the brush so as to bear against the inside of said groove and hold the brush therein by friction.

By means of this type of mounting, it is possible to provide a standard link element that is capable of receiving a brush selected from a plurality of brushes as a function of the desired makeup effect.

In addition, the shape of the groove is advantageously used to act on the direction in which the bristles of the brush are oriented.

In particular, the width of the opening of the groove can be small enough to urge together the bristles of the brush that are used for applying the substance once the brush has been put into place in said groove, thereby making a brush that is flatter, or even tapering.

Furthermore, the longitudinal edges of the groove can overlie the bristles for a fraction of their length so as to constrain them to take up a determined direction and thereby contribute to increasing the stiffness thereof.

The groove can also be open in a direction that is at an angle with the longitudinal axis of the applicator, so as to incline the plane of the bundle of bristles used for applying the substance relative to the longitudinal axis of the applicator, e.g. for the purpose of making the applicator easier to manipulate.

In a particular embodiment, the brush is fixed via its two ends to the link element, preferably bearing between its ends against the front edge of the link element.

The brush can then rest against a curved surface, e.g. a surface which is convex or concave towards the outside, giving the brush a profile that is adapted to the use for which it is intended.

Still in a particular application, the core extends in rectilinear manner along a direction that makes an angle with the axis of the applicator, e.g. to facilitate the operation of making-up.

Still in a particular application, the link element has teeth having substantially the same orientation as the bristles of the brush that are used for applying the substance.

Said teeth may advantageously be integrally molded with the link element.

In a particular embodiment, the receptacle houses a wiper member.

In a particular embodiment, the wiper member comprises a block of foam, preferably a foam having cells that are open or semi-open.

In a variant, the wiper member has at least one flocked edge and the link element then preferably has a narrow portion that engages said flocked edge when the applicator is in place in the receptacle, such that the bristles ot the flocking are not significantly compressed by the link element.

In a particular embodiment, the handle element includes a moving portion for locking the applicator to the receptacle.

Preferably, the length of the free portions of the bristles extending beyond the link element for use in applying the substance lies in the range 1 mm to 60 mm, preferably in the range 3 mm to 30 mm, and more preferably still in the range 5 mm to 15 mm.

In a particular embodiment, the brush has 10 to 40 bristles per turn.

The invention also provides a method of making an applicator of the invention, the method comprising the steps consisting in:

making a twisted wire brush type brush by holding bristles captive between at least two twisted-together wires;

machining the brush in such a manner that the bristles that are for use in applying the substance extend, when the brush is observed in a section plane perpendicular to the core, over a sector of angular extent that is less than 180°; and securing the brush, preferably via at least two points along its length, to one end of a link element which is provided at its other end with a handle element.

In a particular implementation of the method, the brush is machined differently as a function of position along the longitudinal axis of the brush, thereby giving it a specific profile that is specially adapted to the desired makeup effect.

It is thus possible to machine the brush in such a manner as to provide teeth or to ensure that the bristles that are to be used for applying the substance are of a length that decreases from one longitudinal end of the brush towards the other.

Still in a particular implementation of the method, the method further comprises the step of securing the brush to the link element by engaging it in a groove of the link element, said groove being provided with an opening through which the bristles for applying the substance project.

The invention also provides an applicator for applying a substance, the applicator having an axis and being provided along said axis at one end with a handle element and at the other end with an applicator element, the handle element and the applicator element being united by a link element, wherein the applicator element comprises a twisted wire brush type brush whose core extends in a direction that is not parallel to the axis of the applicator, the link element and the brush also being shaped in such a manner that the bristles which extend from the link element for use in applying the substance are contained in a sector of angular extent not greater than 180° about said core.

The invention also provides the use of a device as mentioned above for making-up the eyelashes.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
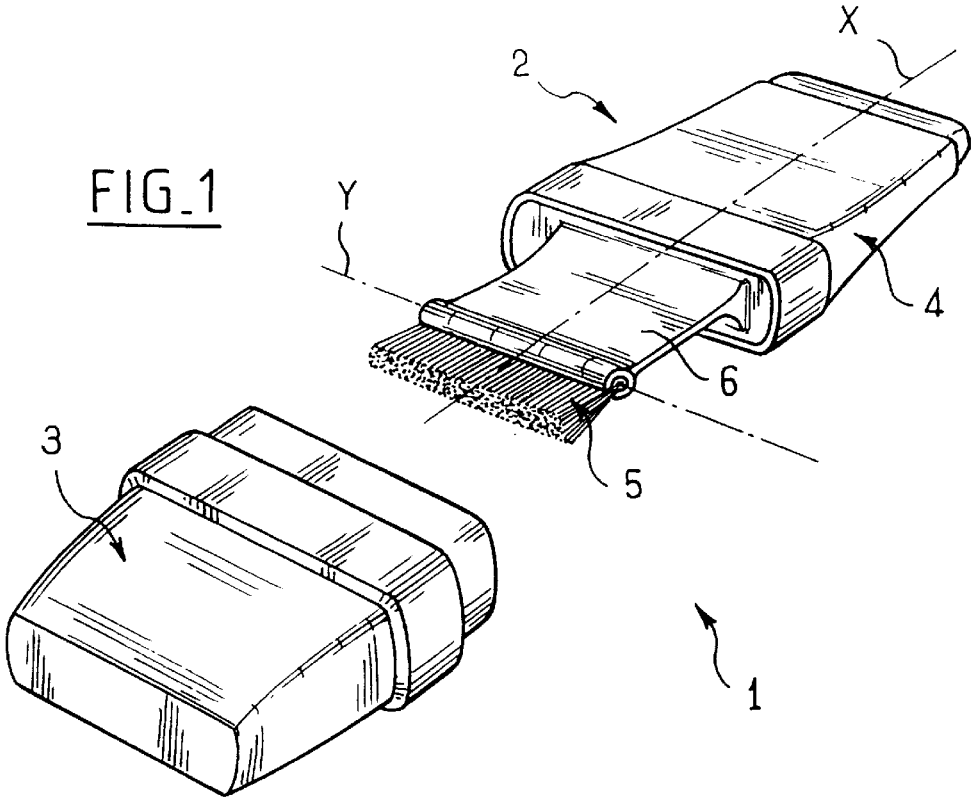
FIG. 1 is a diagrammatic perspective view of a device constituting a first embodiment of the invention.

The device 1 shown in FIG. 1 comprises an applicator 2 and a receptacle 3 of generally flat shape.

The applicator 2 has a longitudinal axis X and comprises at one end a handle element 4 and at its other end an applicator element 5 whose structure is described in detail below. The handle element 4 and the applicator element 5 are united by a link element 6, which is generally flat in shape and suitable for being received in the receptacle 3, and it can be flexible or rigid.

In this example, the axis X is rectilinear, but in a variant that is not shown, it need not be rectilinear.

The link element 6 can be made as a single piece by molding a plastics material, or it may comprise a plurality of pieces that are made separately, and the applicator element 5 can be secured to the link element by means of a piece that is fitted to the remainder of the link element.

Figure 2:
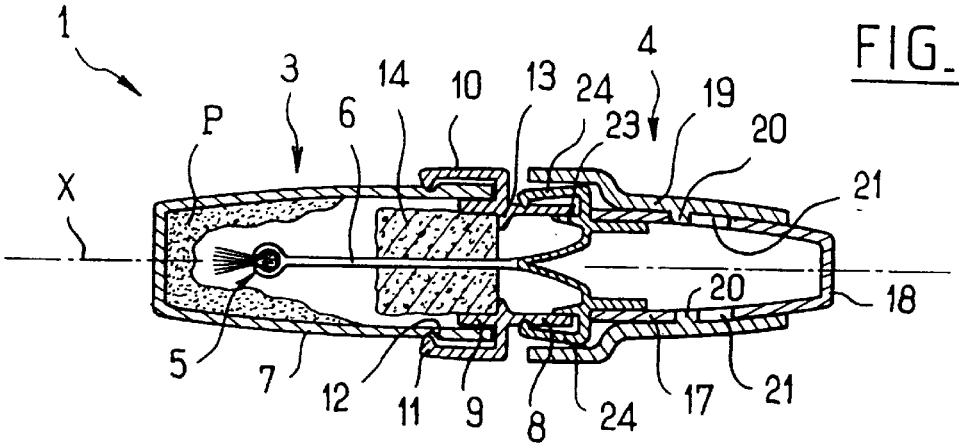
FIG. 2 is a diagrammatic axial section of the FIG. 1 device, the applicator being in place in the receptacle.
Figure 3:
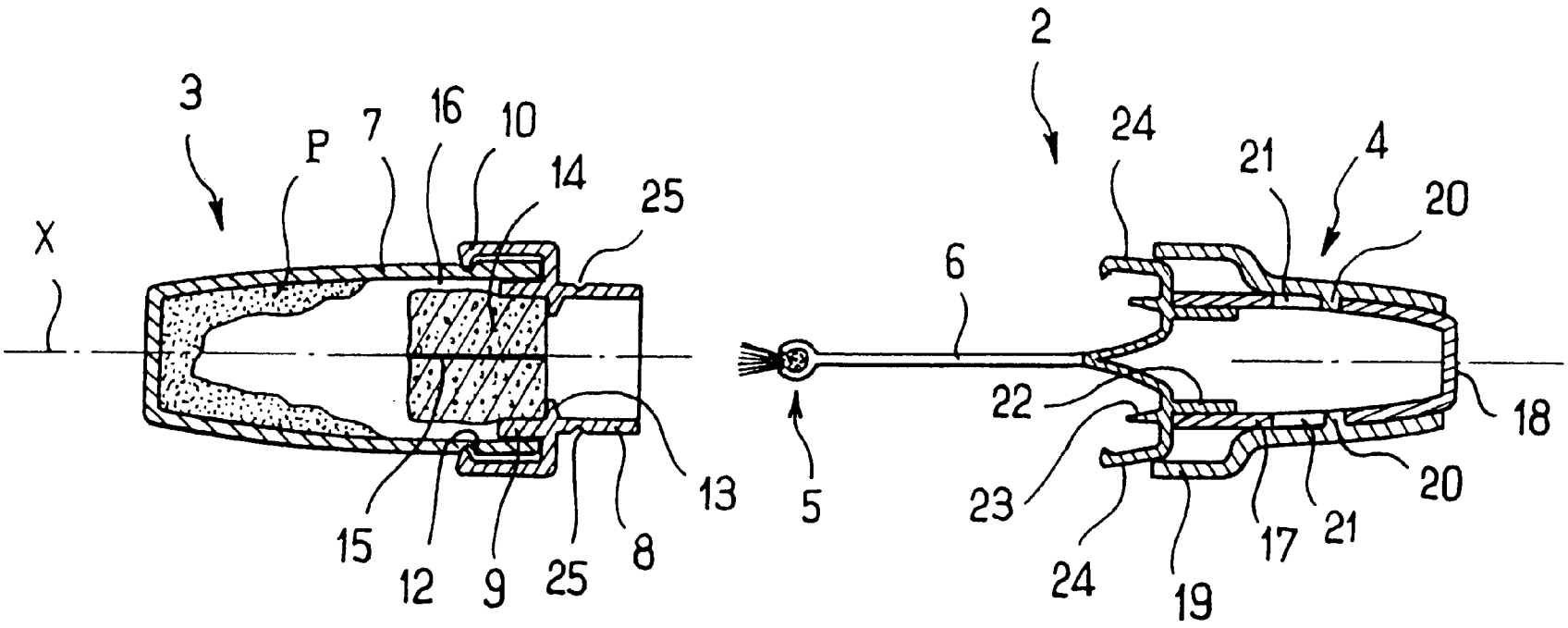
FIG. 3 is a diagrammatic view analogous to FIG. 2, with the applicator being withdrawn from the receptacle.

As can be seen in FIGS. 2 and 3, in the embodiment described, the receptacle 3 contains a substance P of viscous consistency, e.g. mascara.

In the example under consideration, the receptacle 3 is made by assembling together a body 7 and an endpiece, the endpiece being provided with a neck 8 extending the body 7, an inner sealing skirt 9 bearing in sealed manner against the inside surface of the body 7, and an outer mounting skirt 10 provided with portions in relief 11 that snap into a groove 12 formed in the outside surface of the body 7.

At its base, the neck 8 has an inwardly-directed collar 13 which co-operates with the inner skirt 9 to secure a wiper member constituted in this example by a block of foam 14, which member has an axial slot 15 passing therethrough that is substantially closed after the applicator has been withdrawn, as can be seen in FIG. 3. The thickness of the link element where it passes through the block of foam when the applicator is in place in the receptacle is preferably small enough to avoid excessively compressing the foam and deforming the wiper member in the end, for example this thickness may lie in the range 0.8 mm to 2.5 mm.

It will be observed that an annular space 16 is provided around the block of foam 14 behind the inner skirt 9 so as to enable it firstly to deform more easily when the applicator element 5 passes therethrough, and secondly to incline the link element 6 relative to the axis of the receptacle 3 if necessary in order to use the applicator element 5 to remove substance P from the side wall of the body 7.

In the example described, the wiper member 14 is constituted by foam having cells that are open or semi-open.

The handle element 4 comprises a body 17 that is closed at one end 18, and on which there is mounted a ring 19 that is slidable between a position for locking the applicator 2 on the receptacle 3, as shown in FIG. 2, and a position for withdrawing the applicator, as shown in FIG. 3.

In its displacement, the ring 19 is guided by a slideway type link, e.g. constituted by studs 20 formed on the ring 19 and retained in slots 21 formed in the body 17.

The link element 6 is secured to the handle element 4 by means of a mounting skirt 22 inserted as a force-fit in the opening of the body 17.

On the body 17, the handle element 4 has an annular sealing lip 23 designed to press against the inside surface of the neck 6 when the applicator 2 is in place, as can be seen in FIG. 2.

The handle element 4 also has elastically deformable retaining lugs 24 capable of engaging in grooves 25 formed in the neck 8 for the purpose of retaining the applicator 2 on the receptacle 3.

The lugs 24 are deformed elastically towards one another by the ring 19 when it is moved into the locking position, until they engage in the grooves 25.

To withdraw the applicator 2, the user moves the ring 19 towards the back of the body 17, thereby releasing the lugs 24 and enabling the applicator 2 to be separated from the receptacle 3.

When the applicator 2 is put back into place on the receptacle 3, the user moves the ring 19 forwards to lock on the applicator.

The applicator element 5 is made by a method which is described below with reference to FIGS. 4 to 9.

Figure 4:
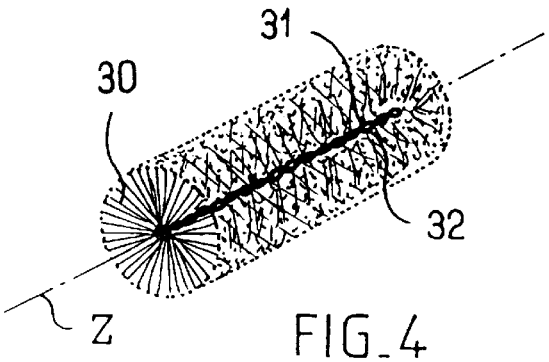
FIGS. 4 to 9 show various steps in the manufacture of the brush and its installation in the link element, with FIG. 6 being a view along arrow VI of FIG. 5.

The method starts with a twisted wire brush type brush shown diagrammatically in FIG. 4 and made in conventional manner by placing a sheet of bristles 30 between two metal strands 31 and 32 that are then twisted together to constitute a core of longitudinal axis Z, the bristles being held by being clamped between the turns of the core made in this way.

The two metal strands 31 and 32 may come from a single wire folded into a U-shape, with the diameter of the wire lying, for example, in the range 2/10 mm to 9/10 mm. In a variant, the two strands can come from two distinct wires that are twisted together continuously and cut into lengths to form a corresponding number of brushes.

Thereafter, the brush is machined to give it the desired profile.

Figure 5:
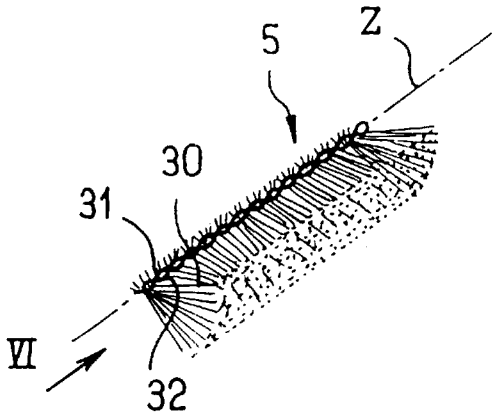
Figure 6:
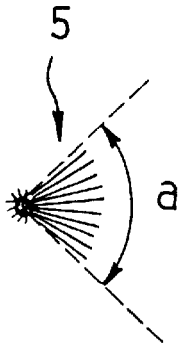

In the example under consideration, after machining, the long bristles 30 for applying the substance extend radially from the core over a sector about the axis Z occupying an angular extent a of less than 180°, as shown in FIGS. 5 and 6.

The brush can be milled to impart a particular shape to the ends of the bristles, e.g. a fork shape, and/or it can optionally be singed to form beads at the ends of the bristles.

At its end remote from the handle element 4, the link element 6 has a swelling 33 defining a groove 35 of substantially circular section about a longitudinal axis Y and shaped to receive the core of the brush, and opening out towards the front of the link element via an opening 34.

Figure 7:
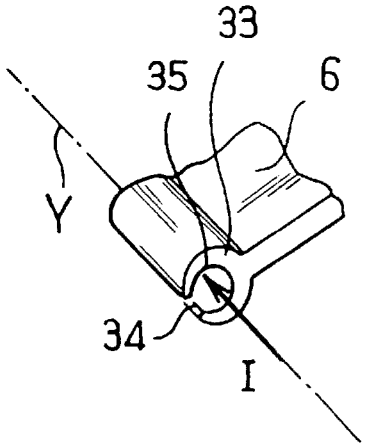
Figure 8:
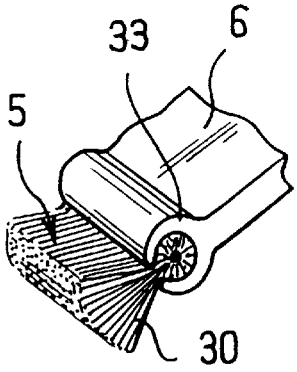
Figure 9:
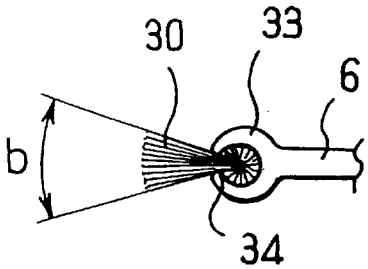

In the example of FIGS. 7 to 9, the swelling 33 has an outside surface of substantially circular cross-section.

The brush 5 is engaged into the groove 35 from one end, in the direction of arrow I in FIG. 7.

After the brush has been put into place in the groove 35, the long bristles 30 project through the opening 34 as shown in FIG. 8 to constitute a surface for applying the substance. The short bristles press against the inside surface of the groove 35 to hold the brush therein by friction.

Depending on the width of the opening 34 of the groove 35, the bristles 30 projecting from the link member cover a sector of angular extent b that may be less than or equal to the above-mentioned angular extent a, depending on whether it is desired to provide an applicator element that is flat or not so flat or even tapering.

Naturally, without going beyond the ambit of the present invention, it is possible to give various profiles to the brush 5 before mounting it on the link element 6.

Figure 10:
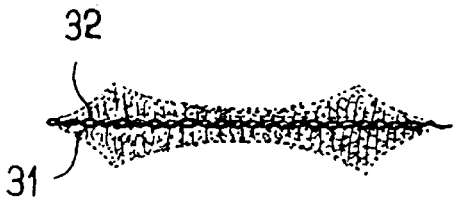
FIGS. 10 and 11 show variant embodiments of the brush.

By way of non-limiting example, FIG. 10 shows the profile of a brush which has been machined in such a manner as to cause the envelope of the bristles to present a diabolo-shaped profile along the longitudinal axis of the brush.

It is thus possible to make a brush whose bristles are longer at its ends than in its middle portion.

The brush of FIG. 10 is then subjected to additional machining so as to retain long bristles only in a predetermined angular sector about the core, like the brush shown in FIG. 5.

It is also possible to machine the brush so that the envelope of the bristles is in the form of a cone whose axis coincides with the core.

After machining to retain bristles suitable for applying makeup only over a determined angular sector about the core, it is possible to obtain a brush whose bristles used for applying the substance present a length that increases linearly from one side of the link element to the other.

It will be observed that the brush in FIG. 1 is chamfered at its ends so as to facilitate insertion thereof into the groove 35 via one or other of its ends.

Figure 11:
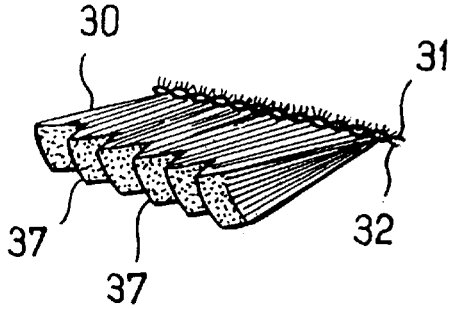

It is also possible to machine the bristles 30 occupying a determined angular sector about the core in such a manner as to make teeth, for example, as shown in FIG. 11.

Such teeth can be useful for combing the eyelashes while applying mascara.

Figure 12:
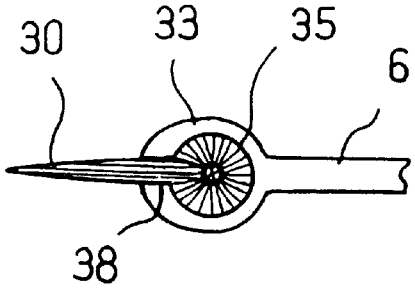
FIGS. 12 and 13 show variant embodiments of the invention, concerning the way in which the bristles of the brush are oriented.

FIG. 12 shows a variant embodiment in which the swelling 33 has an outside surface of cross-section that is substantially oval. The bristles of the brush leave via an opening 38 that is deeper and narrower than in the embodiment of FIG. 9 and that has edges which are substantially parallel, such that the portions of the bristles which extend beyond the link element are substantially parallel.

Figure 13:
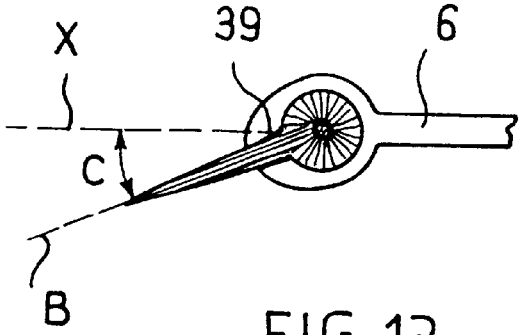

FIG. 13 shows another variant in which the opening 39 of the groove is oriented in a direction B and an angle c with the longitudinal axis X.

This inclination of the bristles of the brush can be useful in making the applicator easier to handle while applying makeup.

In general, the edges of the opening of the groove can be divergent and/or narrow so that the bundle of bristles projecting beyond the link element flares as shown in FIG. 8, is convergent, and/or wider so as to obtain a tapering bundle as shown in FIG. 13, or a bundle that is substantially parallel as in the embodiment of FIG. 12.

In addition, by ensuring that the outermost bristles of the bundle projecting from the link element are deflected where they connect with the core, the free ends of the outermost bristles of the bundle are caused to be set back from the free ends of the bristles situated deeper into the bundle.

It is thus possible, starting from a brush whose envelope is cylindrical prior to machining, to obtain a bundle whose thickness tapers towards its free end, as shown in FIGS. 12 and 13.

Figure 14:
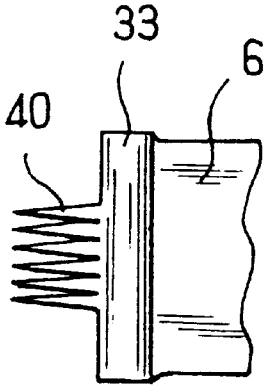
FIGS. 14 and 15 show a first variant of the applicator.

As shown in FIG. 14, the swelling 33 may also have teeth 40 extending from one side of the opening 34, for example.

These teeth 40 can be used, for example, to comb the eyelashes before, during, or after mascara has been applied by means of the brush 5.

Figure 15:
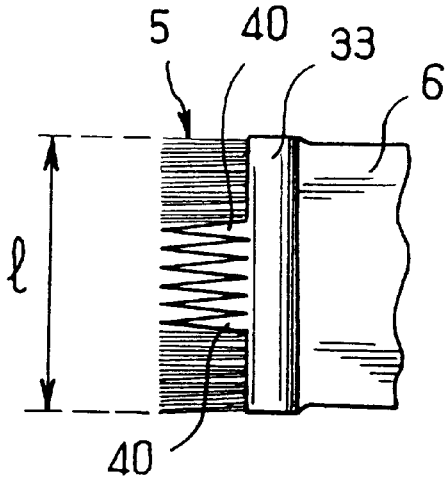

The brush may have bristles substantially over the entire width l of the swelling 33, or as shown in FIG. 15, it may have bristles only on either side of the teeth 40, or beneath them.

In the above-described embodiments, the core constituted by the twisted strands 31 and 32 is rectilinear.

Figure 16:
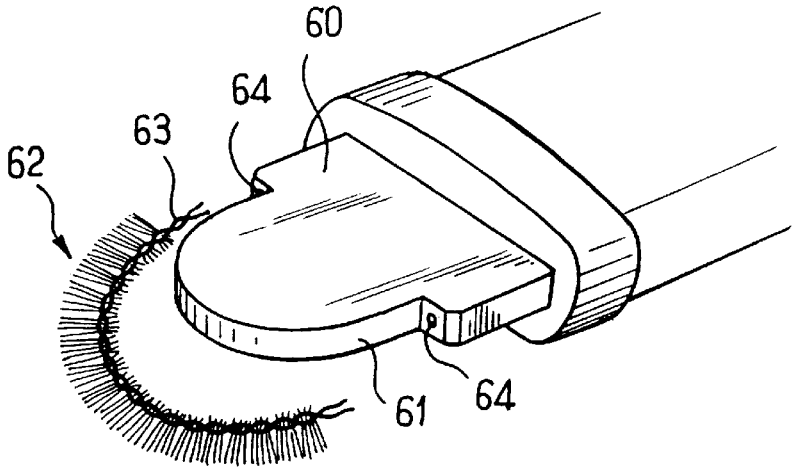
FIGS. 16 to 21 show other variants of the applicator.
Figure 17:
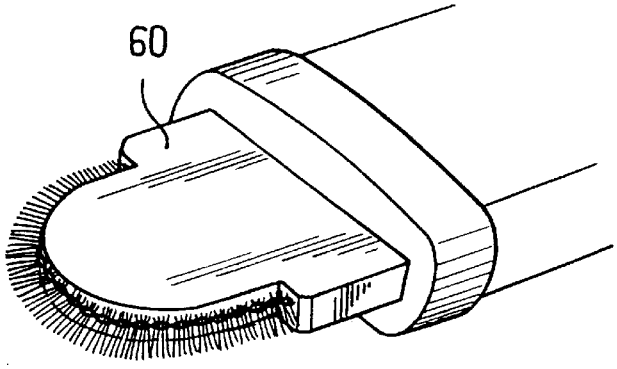

It does not go beyond the ambit of the present invention to use a brush whose core extends along a curved path, e.g. an arc of a circle as shown in FIGS. 16 and 17.

In this embodiment, the link element, referenced 60, has a rounded front edge 61 against which a brush 62 is applied.

The ends of the core 63 of the brush 62 are secured in holes 64 formed in the link element 60 at each end of the rounded edge 61.

Thus, the brush in this case is fixed to the link element via its two ends, only.

Figure 18:
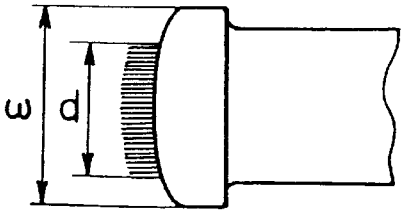
Figure 19:
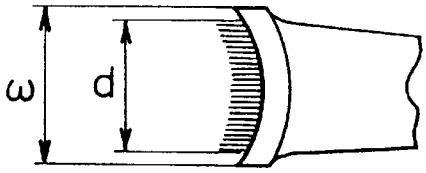

By way of non-limiting example only, FIGS. 18 and 19 show variant embodiments in which the core of the brush follows a path that is slightly convex towards the front (FIG. 18) or slightly concave towards the front (FIG. 19), with the apparent width d of the brush in both cases being less than the length w of the groove receiving the core of the brush.

Figure 20:
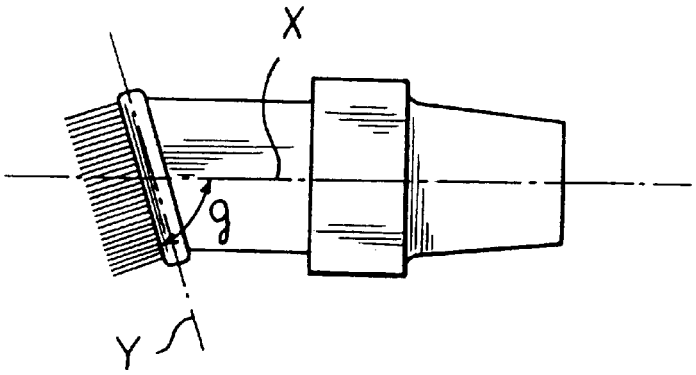

As shown in FIG. 20, the core of the brush may also extend in rectilinear manner, but along an axis Y that is at an angle g with the longitudinal axis of the applicator, where said angle g lies in the range 0 to 45°, for example.

Inclining the brush in this way can make the applicator easier to use.

Figure 21:
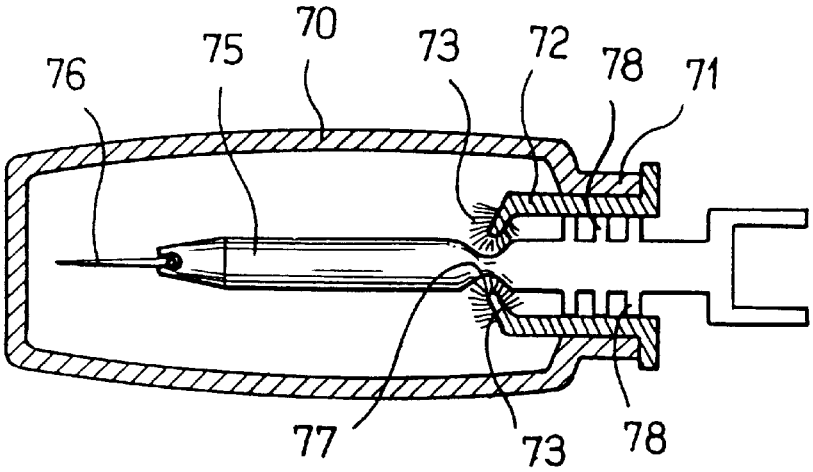

FIG. 21 shows a variant embodiment of the receptacle.

In this example, the receptacle has a body 70 with a neck 71 in which an endpiece 72 is inserted, the end of the endpiece that is situated inside the body 70 being provided with flocked wiping lips 73.

The applicator, which is represented solely by the applicator element 76 arid the link element 75, has a narrow portion 77 which, when the applicator is in place inside the receptacle, is received between the wiper lips 73 so that the bristles of the flocking thereon are not significantly compressed by the link element 75.

The link element 75 also has a succession of sealing lips 78 engaged in the neck 71 and pressing against the insert 72 to close the receptacle in sealed manner when the applicator is in place.

The spacing between the wiper lips 73 is selected as a function of the thickness of the link element and as a function of the thickness of the applicator element so as to be able to wipe the applicator element without impeding withdrawal of the applicator.

By making the applicator element from a brush of the twisted wire brush type, the invention benefits from the advantages associated with the way in which bristles are implanted in this type of brush.

Figure 22:
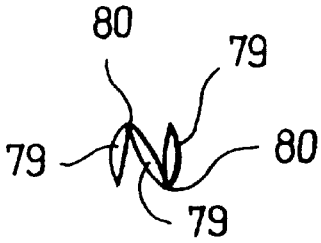
FIG. 22 is a cross-section through one example amongst others of a bristle suitable for use in an applicator of the invention.

In particular, the invention makes it possible to use bristles having a wide variety of sections, for example bristles that are made by extrusion and that comprise, in cross-section and as shown in FIG. 22, a plurality of portions 79 that are interconnected via hinge-forming zones 80 of preferential deformation.

Also, because the bristles of the brush are wiped substantially parallel to their axes, it is possible to avoid making the disagreeable popping noise that occurs with known applicators that use a bottle-brush type of brush with the core extending parallel to the direction in which the applicator is withdrawn from the receptacle.

The invention also makes it possible to use new mascara formulations unsuitable for use with conventional applicators because of the stresses to which they are subjected during wiping or because of the risk of drops of the substance squirting away when the applicator leaves the wiper member.

Naturally, the invention is not limited to the embodiments described above, and the characteristics thereof can be combined.

In particular, the brush used for making the applicator element can have bristles of different diameters and/or different sections and/or different materials, and bristles that are optionally flocked; the wires constituting the core of the brush can be twisted in one direction or the other, and optionally there can be more than only two wires.

The diameter of the bristles can lie, for example, in the range 0.4 mm to 0.7 mm, and preferably in the range 0.06 mm to 0.4 mm.

The width of the bundle of bristles for applying the substance, as measured perpendicularly to the axis X, is preferably equal to at least one-fourth of the width of the eyelid when the applicator is intended for applying mascara to the eyelashes.

The receptacle need not include a wiper member, but could have a block of substance that disperses when it comes into contact with the bristles of the brush.

The receptacle can be of various different shapes, as can the handle element and the link element, without thereby going beyond the ambit of the present invention.

The device of the invention is particularly suitable for applying mascara on the eyelashes, however it would not go beyond the ambit of the present invention to use it for applying any other substance, in powder, liquid, or semi-liquid form, e.g. to the eyebrows or to the hair, or indeed to the nails, to the skin, or to the lips, either for makeup purposes, or in the context of cosmetic or pharmaceutical treatment.

What is claimed is:

1. A device for applying a substance, in particular a cosmetic, the device comprising a receptacle containing a supply of substance, and an applicator having an axis, the applicator being provided at one end with a handle element and at the other end with an applicator element, the handle element and the applicator element being interconnected by a link element, wherein the applicator element comprises a twisted wire brush type brush whose core extends in a direction that is not parallel to the axis of the applicator, and wherein the link element and the brush are shaped in such a manner that the bristles extending from the link element for use in applying the substance are contained in a sector of angular extent that is not greater than 180° about said core.

2. A device according to claim 1, wherein the brush is secured at at least two points along its length to the link element.

3. A device according to claim 1, wherein the link element is substantially flat.

4. A device according to claim 1, wherein the bristles for applying the substance extend over a sector of angular extent about the core that is less than 120°.

5. A device according to claim 1, wherein the bristles for applying the substance constitute a bundle centered on a plane containing the axis of the applicator.

6. A device according to claim 1, wherein the bristles for applying the substance constitute a bundle that diverges going away from the link element when the applicator is observed in section in a plane perpendicular to the core.

7. A device according to claim 1, wherein the bristles for applying the substance are substantially parallel in their free portions extending beyond the link element.

8. A device according to claim 1, wherein the link element includes a groove, and wherein the core of the brush is inserted in said groove.

9. A device according to claim 8, wherein the width of the opening of said groove is narrow enough to urge together the bristles of the brush that are used for applying the substance, once the brush has been put into place in the groove.

10. A device according to claim 1, wherein the link element has teeth having substantially the same orientation as the bristles of the brush that are used for applying the substance.

11. A device according to claim 10, wherein said teeth are integrally molded with the link element.

12. A device according to claim 11, including a wiper member housed in the receptacle and through which the applicator element is extracted from the receptacle.

13. A device according to claim 12, wherein the wiper member comprises a block of foam.

14. A device according to claim 13, wherein the wiper member is constituted by a block of foam having cells that are open or semi-open.

15. A device according to claim 12, wherein the wiper member has at least one flocked edge.

16. A device according to claim 1, wherein the handle element includes a moving portion for locking the applicator to the receptacle.

17. A device according to claim 4, wherein said angular extent is less than 90°.

18. A device according to claim 4, wherein said angular extent is less than 60°.

19. A device according to claim 8, wherein said groove is of a length that is not less than the length of the core of the brush so that the brush is held to the link element over its entire length.

20. A device according to claim 15, wherein the link element has a narrow portion that engages said flocked edge when the applicator is in place in the receptacle so as to ensure that the flocking bristles are not significantly compressed by the link element.

21. A method for making up eyelashes comprising applying a cosmetic to a person's eyelashes with the device of claim 1.

22. A device for applying a substance in particular a cosmetic, the device comprising a receptacle containing a supply of substance and an applicator having an axis, the applicator being provided at one end with a handle element and at the other end with an applicator element the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core, wherein the link element is of a width not less than the width of the brush.

23. A device for applying a substance, in particular a cosmetic, the device comprising a receptacle containing a supply of substance, and an applicator having an axis, the applicator being provided at one end with a handle element and at the other end with an applicator element, the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core and the bristles for applying the substance constitute a bundle centered on a plane extending obliquely relative to the axis of the applicator.

24. A device for applying a substance, in particular a cosmetic, the device comprising a receptacle containing a supply of substance, and an applicator having an axis, the applicator being provided at one end with a handle element and at the other end with an applicator element, the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core, and the bristles for applying the substance constitute a bundle that converges going away from the link element when the applicator is observed in a section plane perpendicular to the core.

25. A device for applying a substance, in particular a cosmetic, the device comprising a receptacle containing a supply of substance, and an applicator having an axis, the applicator being provided at one end with a handle element and at the other end with an applicator element, the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core, and the bristles for applying the substance constitute a bundle in which the bristles are of length that decreases from the inside of the bundle towards the outside of the bundle when the applicator is observed in section in a plane perpendicular to the core.

26. A device for applying a substance, in particular a cosmetic, the device comprising a receptacle containing a supply of substance, and an applicator having an axis, the applicator being provided at one end with a handle element and at the other end with an applicator element, the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core, and the brush is fixed to the link element at its two ends.

27. A device according to claim 26, wherein, between its ends, the brush bears against the front edge of the link element.

28. A device according to claim 27, wherein the core extends in rectilinear manner along a direction that makes an angle with the axis of the applicator.

29. A device for applying a substance, in particular a cosmetic, the device comprising a receptacle containing a supply of substance, and an applicator having an axis, the applicator being provided at one end with a handle element and at the other end with an applicator element, the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core, and the length of free portions of the bristles extending beyond the link element for use in applying the substance lies in the range 1 mm to 60 mm.

30. A device according to claim 29, wherein said length lies in the range of 3 mm to 30 mm.

31. A device according to claim 29, wherein said length lies in the range of 5 mm to 15 mm.

32. A device for applying a substance, in particular a cosmetic, the device comprising a receptacle containing a supply of substance, and an applicator having an axis the applicator being provided at one end with a handle element and at the other end with an applicator element the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core, and the bristles present a cross-section that is not circular and/or not constant from one end of their length to the other.

33. A device for applying a substance, in particular a cosmetic, the device comprising a receptacle containing a supply of substance, and an applicator having an axis, the applicator being provided at one end with a handle element and at the other end with an applicator element, the handle element and the applicator element being interconnected by a link element, wherein the applicator element comprises a twisted wire type brush whose core extends in a direction that is not parallel to the axis of the applicator, and the link element and the brush are shaped in such a manner that the bristles extending from the link element for use in applying the substance are contained in a sector of angular extent that is not greater than 180° about said core, in which the core includes turns, wherein the brush has ten to 40 bristles per turn.

34. An applicator for applying a substance, the applicator having an axis and being provided along said axis at one end with a handle element and at the other end with an applicator element, the handle element and the applicator element being united by a link element, wherein the applicator element comprises a twisted wire brush type brush whose core extends in a direction that is not parallel to the axis of the applicator, the link element and the brush also being shaped in such a manner that the bristles which extend from the link element for use in applying the substance are contained in a sector of angular extent not greater than 180° about said core.

35. A method of making an applicator for a substance, the method comprising:

making a twisted wire brush type brush by holding bristles captive between at least two twisted-together wires forming a core;

machining the brush in such a manner that the bristles that are for use in applying the substance extend, when the brush is observed in a section plane perpendicular to the core, over a sector of angular extent that is less than 180°; and securing the brush to one end of a link element which is provided at its other end with a handle element.

36. A method according to claim 35, wherein the brush is machined differently as a function of position along the longitudinal axis of the brush.

37. A method according to claim 36, wherein teeth are formed on the brush.

38. A method according to claim 36, wherein the brush is machined in such a manner that the bristles that are for use in applying the substance are of a length that decreases from one longitudinal end of the brush towards the other.

39. A method according to claim 35, further including the step of securing the brush to the link element by engaging it in a groove of the link element, said groove being provided with an opening through which the bristles for applying the substance project.

40. A method according to claim 35, wherein said securing step secures the brush via at least two points along its length.

* * * * *